US008635744B2

(12) United States Patent
Junk et al.

(10) Patent No.: US 8,635,744 B2
(45) Date of Patent: Jan. 28, 2014

(54) FOLDABLE HANDLE RETAINER

(75) Inventors: Richard A. Junk, Elkhorn, WI (US); Craig R. Butzlaff, Waukesha, WI (US); Ryan S. Jaskowiak, Mukwonago, WI (US); Shane M. O'Connor, Cottage Grove, WI (US); Andy J. Bingen, Iron Ridge, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 338 days.

(21) Appl. No.: 12/860,046

(22) Filed: Aug. 20, 2010

(65) Prior Publication Data

US 2012/0042477 A1 Feb. 23, 2012

(51) Int. Cl.
*B25G 1/04* (2006.01)

(52) U.S. Cl.
USPC ..... 16/429; 248/230.7; 280/655.1

(58) Field of Classification Search
USPC ..... 16/429, 405, 427, 437, 232, DIG. 24, 16/110.1; 74/543, 547, 551.3, 551.7; 81/489; 15/144.1; 280/47.371, 47.315, 280/655.1; 248/230.7
See application file for complete search history.

(56) References Cited

U.S. PATENT DOCUMENTS

| | | | | | |
|---|---|---|---|---|---|
| 3,357,716 | A * | 12/1967 | Musichuk | ..... | 280/47.371 |
| 3,669,463 | A * | 6/1972 | Boudreau | ..... | 280/47.371 |
| 5,700,137 | A * | 12/1997 | Simonette | ..... | 417/364 |
| 6,024,376 | A * | 2/2000 | Golichowski et al. | ..... | 280/655.1 |
| 6,082,757 | A * | 7/2000 | Lin | ..... | 280/654 |
| 6,520,516 | B2 * | 2/2003 | Favorito et al. | ..... | 280/87.042 |
| 7,003,849 | B2 * | 2/2006 | Cohen et al. | ..... | 16/232 |
| 7,131,166 | B2 * | 11/2006 | Cohen et al. | ..... | 16/232 |
| 7,496,990 | B2 * | 3/2009 | Qiao | ..... | 16/437 |
| 8,307,500 | B2 * | 11/2012 | Gonzales et al. | ..... | 16/113.1 |
| 2009/0313791 | A1 * | 12/2009 | Takemura | ..... | 16/429 |
| 2011/0186004 | A1 * | 8/2011 | Junk et al. | ..... | 123/195 R |
| 2012/0017394 | A1 * | 1/2012 | Junk et al. | ..... | 16/349 |

* cited by examiner

*Primary Examiner* — William Miller
(74) *Attorney, Agent, or Firm* — Rathe Lindenbaum LLP

(57) ABSTRACT

Resiliently movable fingers receive a portion of a foldable handle therebetween to retain the handle against folding relative to a frame.

20 Claims, 10 Drawing Sheets

FOLDABLE HANDLE RETAINER

BACKGROUND

Appliances or implements sometimes include collapsible handles, allowing the implement to be manually pushed or pulled and allowing the handle to be collapsed for storage or transport. Existing collapsible handles may be difficult to collapse and may undesirably vibrate and bounce when extended during operation of the appliance.

DETAILED DESCRIPTION OF THE EXAMPLE EMBODIMENTS

Figure 1:
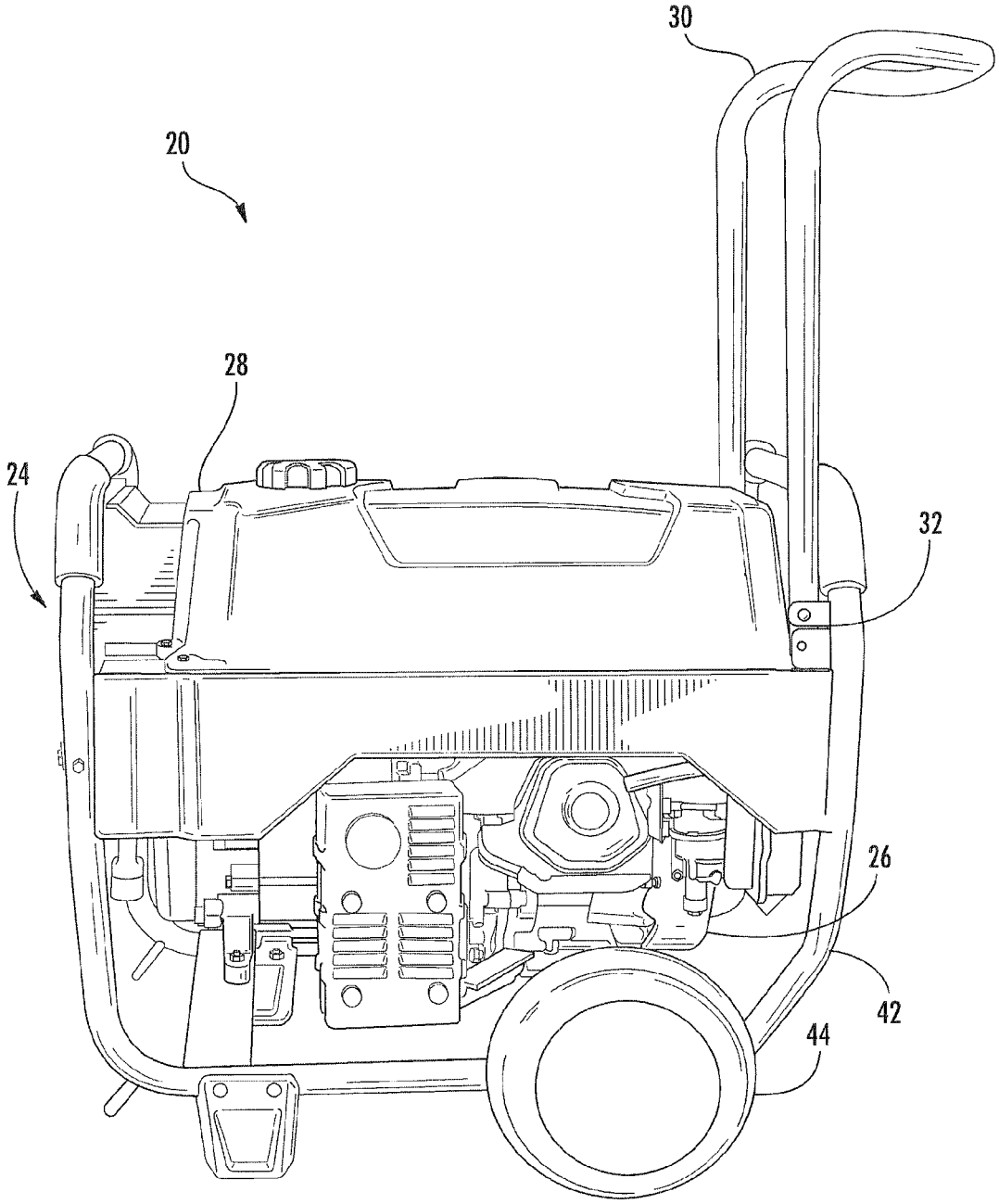
FIG. 1 is a side elevational view of a foldable appliance having a handle retainer, according to an example embodiment, retaining a handle in an extended upright position.
Figure 2:
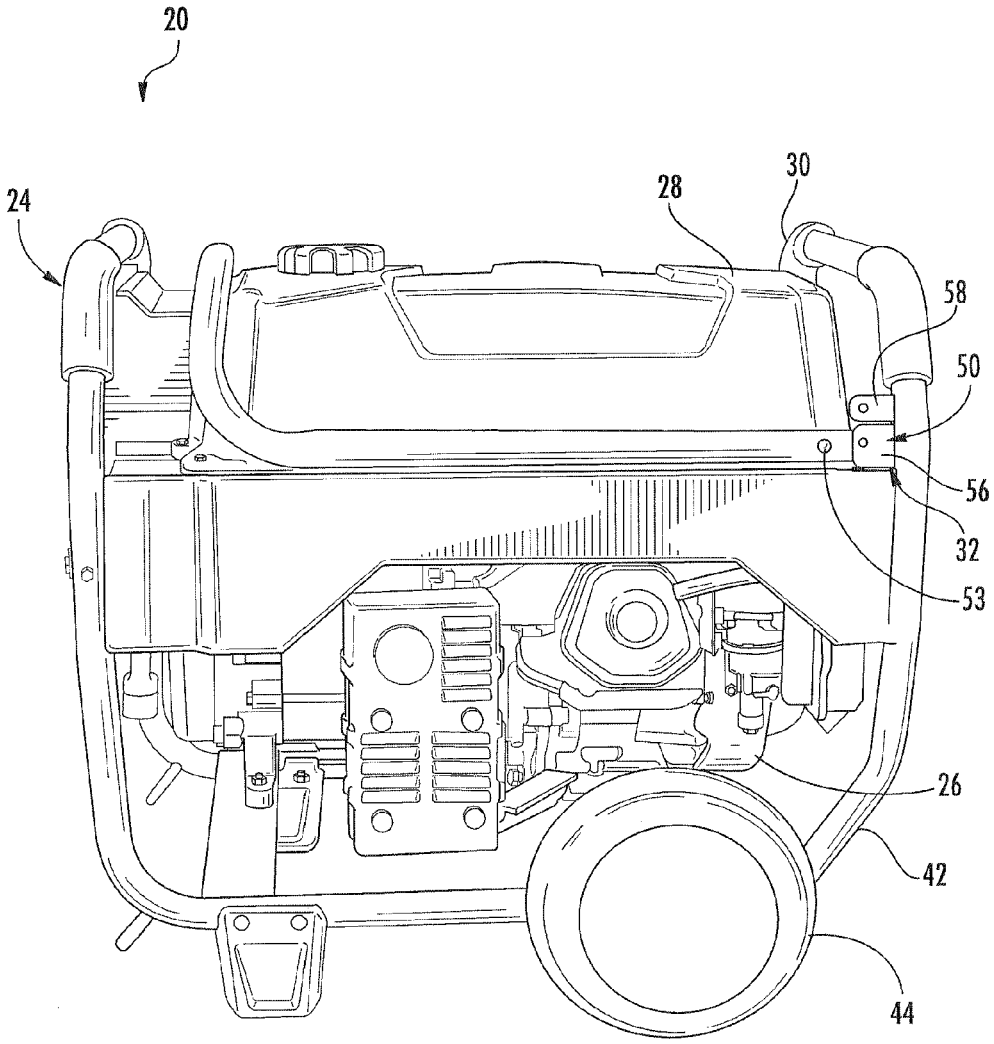
FIG. 2 is a side elevational view of the appliance of FIG. 1 illustrating the handle in a folded or collapsed position.

FIGS. 1 and 2 illustrate a foldable implement or appliance 20 (shown as a fluid sprayer) according to an example embodiment. Appliance 20 delivers fluid under relatively high pressures. As will be described hereafter, Appliance 20 includes a retainer 32 that securely and reliably retains and locks a handle of the appliance in an extended, upright position (shown in FIG. 1), while allowing the handle of the appliance 20 to be folded for compactness during transporting and storage of the appliance 20 (shown in FIG. 2).

Appliance 20 includes support 24, drive unit 26, working unit 28, handle 30 and handle retainers 32. Support 24 comprises one or more structures configured to serve as a foundation for supporting the remaining components of the foldable appliance (appliance 20). In the example illustrated, support 24 includes frame 42 and wheels 44. Frame 42 comprises a series of beams, brackets or other structures extending between wheels 44 and handle 30. Although illustrated as being formed from a shaped tubular member, frame 42 may have other configurations.

Wheels 44 are rotationally coupled to frame 42 and assist in elevating portions of frame 42 above a supporting surface or ground. In the example illustrated, wheels 44 freely rotate or idle. In other embodiments, wheels 44 may be powered or driven by an engine or motor. Although appliance 20 is illustrated as including a pair of wheels 44 (one of which is shown), wherein a front end of frame 42 rests upon the ground or underlying surface, in other embodiments, appliance 20 may include three, four or additional wheels. In yet another embodiment, wheels 44 may be omitted or replaced with other ground motive mechanisms such as tracks, skis or the like. Although wheels 44 are illustrated as being rotationally coupled to frame 42, in other embodiments, wheels 44 may alternatively be operably coupled to portions of drive unit 26 or working unit 28.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Drive unit 26 comprises a unit or mechanism configured to provide or supply torque or other motive force to working unit 28. In the example illustrated, drive unit 26 comprises an internal combustion engine operably coupled to working unit 28 and supported by support 24. In other embodiments, drive unit 26 may alternatively comprise electrically powered motor. In yet other embodiments, drive unit 26 may be omitted, such as where working unit 28 is manually powered.

Working unit 28 comprises one or more mechanisms configured to utilize the received torque or force to transform or work upon the surrounding environment or a medium. In the example illustrated, working unit 28 comprises a fluid pump configured to pressurize fluid, such as water, wherein the pump is connectable to a hose and spray gun which are not shown. According to one embodiment, the pump serving as working unit 28 comprises a pump at least similar to the pump shown and described in U.S. Pat. No. 6,092,998 to Dexter et al. which issued on Jul. 25, 2000, the full disclosure of which is hereby incorporated by reference.

In other embodiments, working unit 28 may comprise mechanisms configured to perform other functions. For example, in other embodiments, working unit 28 may comprise transmission and cutting blades of a lawnmower, trimmer or other cutting mechanism, the transmission and auger of a snow thrower or snow blower, the transmission and tines or blades of a tiller, the electrical power generating components of an electrical generator or other working mechanisms.

Handle 30 extends from support 24 and is configured to be manually grasped by a person using appliance 20, allowing the person to reposition and move appliance 20. In the example illustrated, handle 30 has a generally inverted L-shaped profile formed by a single unitary tube or bar. In other embodiments, handle 30 may have other configurations. Handle 30 is pivotably coupled to frame 42 so as to be pivotable between an extended upright position shown in FIG. 1 and a collapsed or folded position shown in FIG. 2.

Handle retainers 32 comprise mechanisms configured to securely and reliably retain and lock a handle of the appliance in an extended, upright position (shown in FIG. 1), while allowing the handle 30 of the appliance 20 to be folded for compactness during transporting and storage of the appliance 20 (shown in FIG. 2). In the example illustrated, each of handle retainers 32 further pivotably couples handle 32 to a remainder of appliance 20. In other embodiments, separate structures may be utilized to pivotably couple handle 30 to the remainder of appliance 20. Although handle 30 is illustrated as being folded or pivoted in a counter-clockwise direction (as seen in FIG. 1) and in a forward direction over and on top of the remainder of appliance 20, in other embodiments, frame 42 may be shortened or otherwise modified and retainers 32 may be reversed in direction or alternatively configured to allow handle 30 to pivot in a reverse clockwise direction (as seen in FIG. 1), allowing handle 30 to fold to a rear side of appliance 20 rather than over top of appliance 20.

Figure 3:
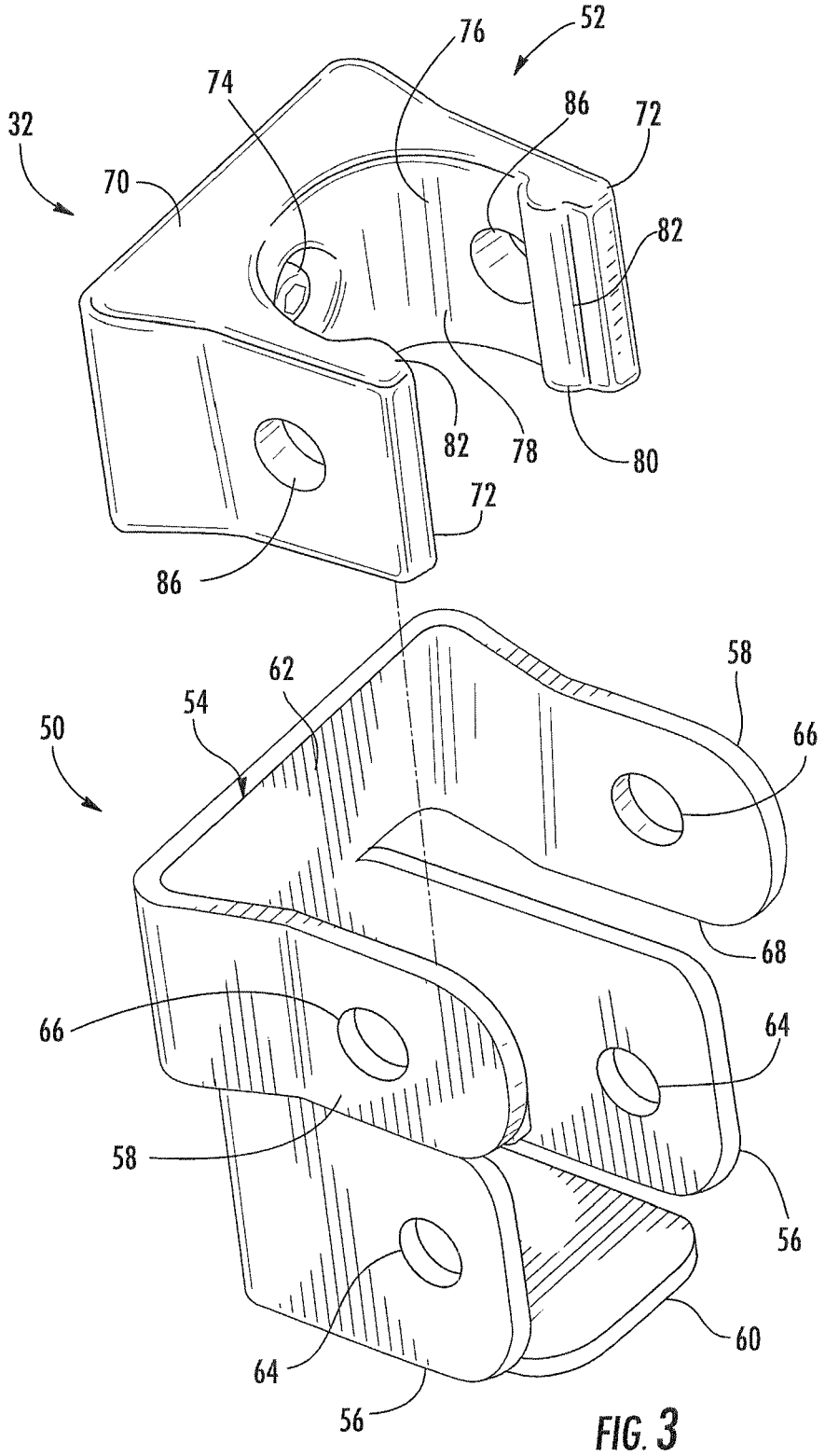
FIG. 3 is an exploded perspective view of a portion of the handle retainer of the appliance of FIG. 1 according to an example embodiment.
Figure 4:
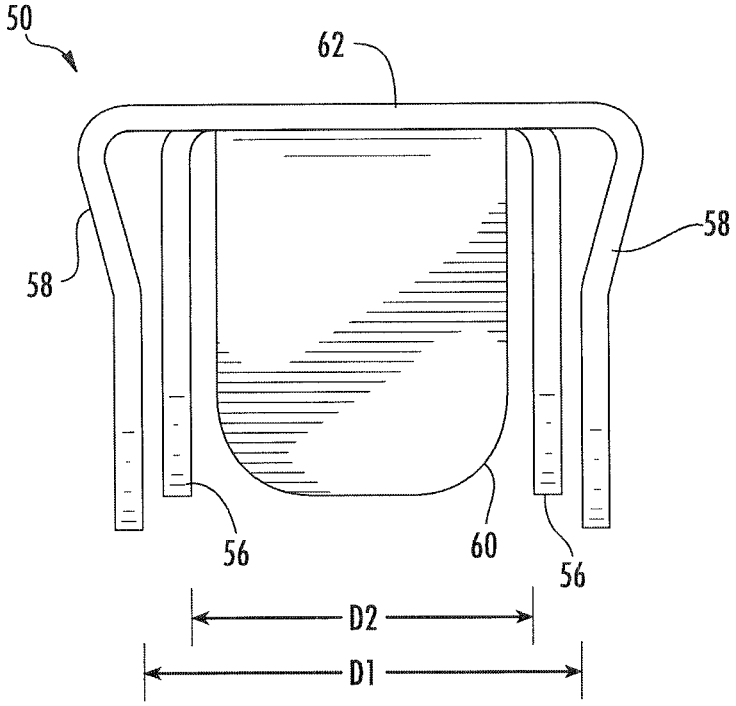
FIG. 4 is a top plan view of a bracket of the retainer of FIG. 3.
Figure 5:
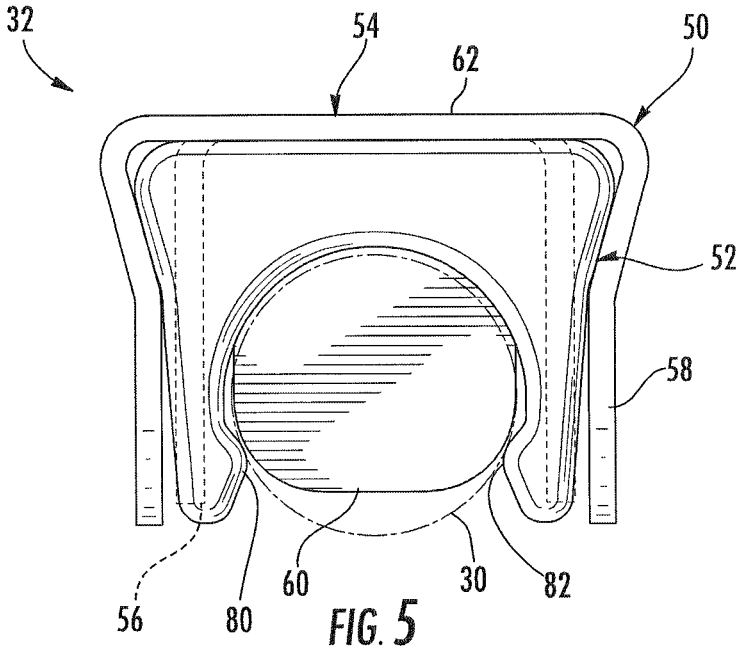
FIG. 5 is a top plan view of the retainer of FIG. 3 receiving a portion of handle 30 (shown in broken lines).

FIGS. 3-5 illustrate one of handle retainers 32 in more detail. As shown by FIG. 3, handle retainer 32 comprises bracket 50 and insert 52. As will be described later, retainer 32 additionally includes projections 53 coupled to and carried by handle 30. Bracket 50 is configured to be coupled to frame 42 (shown in FIGS. 1 and 2) while supporting insert 52. Bracket 50 is further configured to pivotably support handle 30. As a result, retainer 32 comprises a single compact assembly that serves dual functions of pivotably supporting handle 30 and retaining handle 30 in the extended upright position. In other embodiments, other structures may pivotably support handle 30 in place of bracket 50.

In the example illustrated, bracket 50 comprises a base 54, tabs 56 and tabs 58. Base 54 is generally L-shaped, including a first portion 60 and a second portion 62. Portion 60 comprises a portion of base 54 extending from portion 62 at approximately a 90 degree angle. Portion 60 is configured to be fastened, welded, bonded to or otherwise joined to frame 42 when bracket 50 is in the upright position as shown in FIG. 3. Portion 62 extends from portion 60 between 56 and 58. Portion 62 supports tabs 56 and 58.

Tabs 56 comprise flaps or flanges extending opposite to one another from opposite sides of portion 62 of base 54. Tabs 56 are configured to receive an end portion of handle 30 therebetween so as to pivotably support handle 30. In the example illustrated, tabs 56 include a pair of aligned holes or apertures 64 through which pivot pins, axles, bolts or the like may be used to pivotably connect handle 30 to tabs 64. In other embodiments, tabs 56 may alternatively support an end portion of handle 30 in other manners. For example, in other embodiments, tabs 56 may include projections or pins which project from tabs 56 towards one another and into opposing bores within handle 30 to pivotably support handle 30.

Tabs 58 comprise flaps or flanges extending opposite to one another from opposite sides of portion 62 of base 54. Tabs 58 are configured to receive and support insert 52 therebetween. As best shown by FIG. 4, tabs 58 are spaced from one another by a distance D1 while tabs 56 are spaced from one another by a smaller distance D2. As a result, tabs 56 may pivotably support handle 30 while tabs 58 may support insert 52 which wraps about and engages or contacts outer opposite sides of the same handle 30.

In the example illustrated, tabs 58 include a pair of parallel aligned holes or apertures 66. As will be described hereafter, apertures 66 are configured to receive locking pivot pins to further secure handle 30 in the extended, upright position shown in FIG. 1. In other embodiments, such apertures 66 may be omitted.

In the example illustrated, tabs 58 are separated from tabs 56 by opening or slit 68. Tabs 58 are only connected to tabs 56 through portion 62 of base 54. Each of tabs 58 is formed of a material and has an associated thickness such that tabs 58 are resiliently flexible relative to portion 62 of base 54 independent of tabs 56. In other words, tabs 58 may resiliently flex inward and outward during insertion of handle 30 into and removal of handle 30 from insert 52 without tabs 58 substantially correspondingly flexing inward and outward. As a result, tabs 58 facilitate inward and outward flexing of portion of insert 52. As will be described hereafter, tabs 56 remain substantially fixed against such movement to more stably and reliably pivotably support handle 30.

According to one example embodiment, bracket 50 is formed from 12 gauge steel. In one example embodiment, tabs 56 project perpendicularly from portion 62 by a distance of approximately 40 mm and are spaced from one another by the distance D2 of about 35 millimeters. Tabs 58 perpendicularly project from portion 62 by a distance of about 43.3 mm and are spaced apart from one another by a distance D1 of about 44.6 mm. In other embodiments, bracket 50 may have other configurations and may be formed from other materials. For example, in other embodiments, tabs 56 and 58 may be separate component mounted or fixed to one another. In still other embodiments, tabs 58 may be inflexible or rigid, wherein insert 52 flexes inwardly and outwardly relative to tabs 58.

As shown by FIGS. 3 and 5, insert 52 comprises a structure or member supported by tabs 58 that is configured to receive and grip a portion of handle 30 when handle 30 is in the extended, upright position. In the example illustrated, insert 52 comprises a base portion 70 and a pair of opposite resiliently movable or resiliently flexible claws, prongs, hooks, grippers or fingers 72. Base portion 70 supports fingers 72 and is configured to be mounted to portion 62 of base 54 of bracket 50 between tabs 58. In the example illustrated, a fastener 74 extending through base portion 70 is used to join and connect insert 52 to bracket 50. In other embodiments, insert 52 may be mounted or connected to bracket 50 between tabs 58 in other fashions. For example, other fasteners may be used. In still other embodiments, insert 52 may be welded, bonded, adhered or mechanically snapped onto bracket 50. In yet other embodiments, insert 52 may be molded about or onto portions of bracket 50 or may be integrally formed as a single unitary body with bracket 50.

Fingers 72 project from base portion 70 and are spaced from one another so as to form a mouth 76 configured to receive at least a majority of a cross-sectional area of handle 30. In one embodiment, mouth 76 has an internal surface 78 that substantially matches or corresponds to an outer perimeter surface shape of handle 30. In the example illustrated, where the portion of handle 30 that is received by mouth 76 is tubular and has a substantially cylindrical shape, interior surfaces 78 are shaped such that mouth 76 also forms at least part of a cylindrical opening. In other embodiments, mouth 76 may have a shape dissimilar to the shape of that portion of handle 30 received within mouth 76.

Fingers 72 grip opposite sides of handle 30. In particular, fingers 72 are resiliently flexible so as to resiliently flex away from one another the receipt of handle 30. After receipt of handle 30, fingers 72 resiliently return to their initial shape, gripping handle 30. As a result, fingers 72 securely retain handle 30 within mouth 76.

In the example illustrated, fingers 72 are further configured to wrap about the received handle 30 greater than 180 degrees, extending past half of the circular cross-sectional shape of handle 30. Fingers 72 extend towards one another to form a constricted opening 80 between fingers 72 that is smaller then a corresponding diameter of mouth 76. In one embodiment, mouth 76 is C-shaped. To further secure handle 30 within mouth 76, fingers 72 include bumps, nubs, lips or projections 80. As a result, not only is handle 30 frictionally gripped or retained on opposite sides, but is also substantially surrounded by fingers 72. Consequently, handle 30 may be less likely to rattle due to vibration when appliance 20 is being used.

In the example illustrated, insert 52 offers yet a third handle retention mechanism: apertures 86. Apertures 86 comprise detents extending into or through fingers 72 from surface 78. Apertures 86 are configured to receive resiliently biased projections 53 extending from handle 30 as will be described hereafter. In the example illustrated, apertures 86 are aligned with apertures 66 in tabs 58 such that the resiliently biased projections 53 may further extend through apertures 66. As a result, handle 30 is more securely retained in the extended position and held against rattling or vibration.

In other embodiments, apertures 86 may alternatively be aligned with apertures 66 for receiving a bolt, pin or other fastener which also extends through handle 30 to retain handle 30. In other embodiments, apertures 66 may be omitted, where the resiliently biased projections or pins extending from handle 30 project into apertures 86. In such embodiments where apertures 66 are omitted, apertures 86 may alternatively comprise other forms of detents such as indents, notches, channels, grooves or depressions. In still other embodiments, insert 52 may alternatively include resiliently biased or resiliently flexible projections extending within mouth 76 towards one another, wherein the resiliently biased pins, buttons or resiliently flexible projections snap or are urged into corresponding detents (apertures or indents) in handle 30. In yet other embodiments, insert 72 may omit apertures 86.

Figure 6:
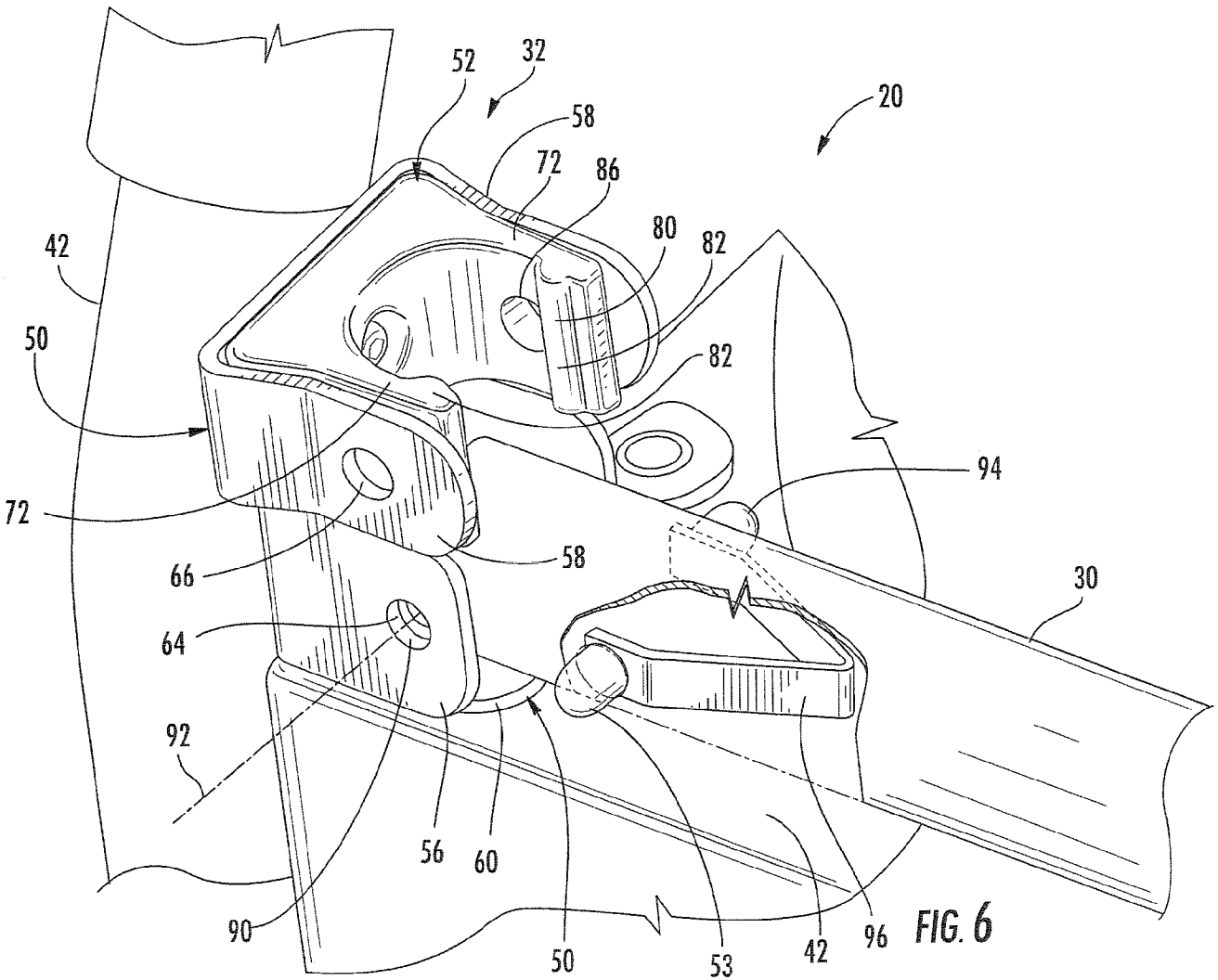
FIG. 6 is a fragmentary enlarged perspective view of the appliance of FIG. 2 illustrating the handle in the folded or collapsed position.
Figure 7:
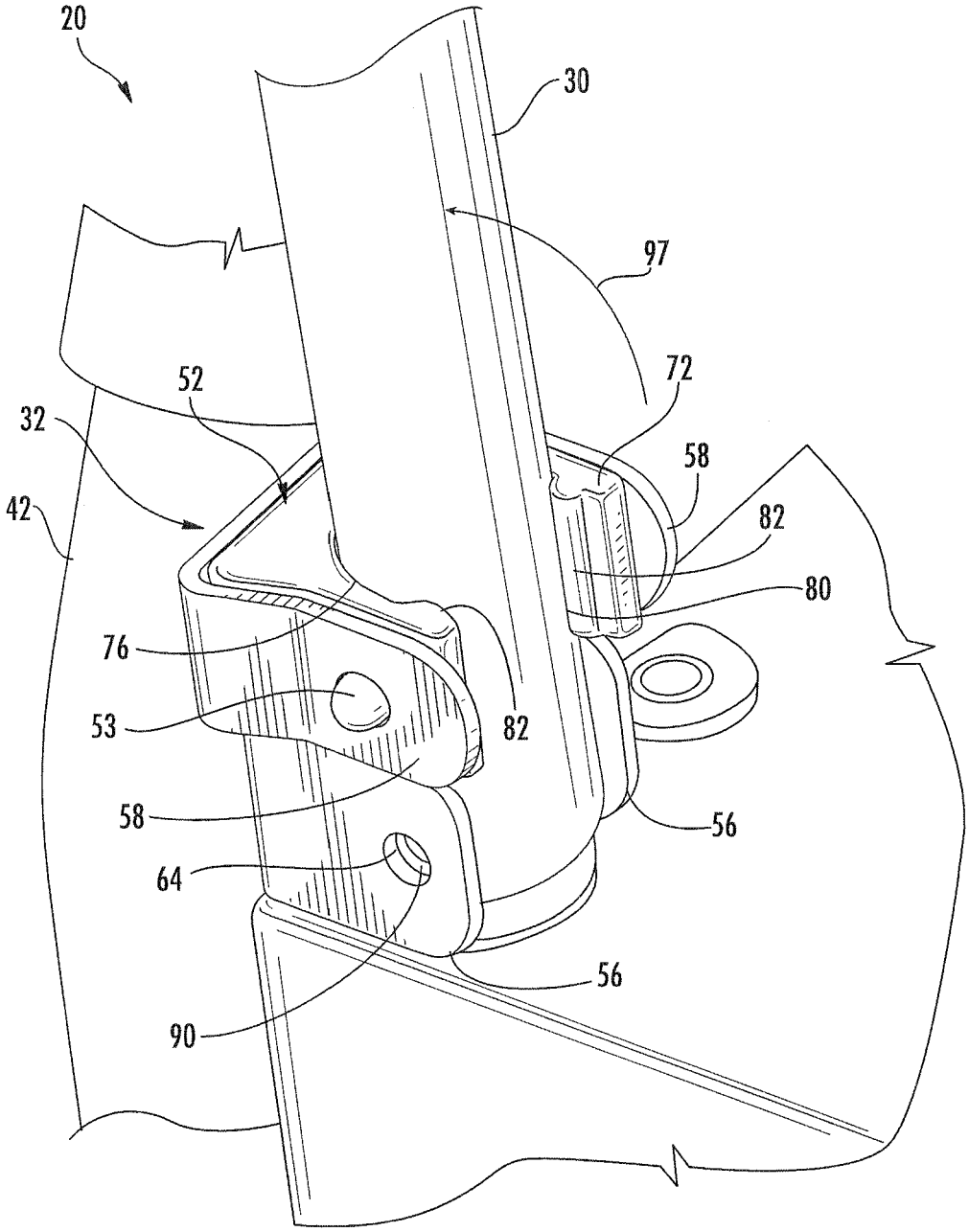
FIG. 7 is a fragmentary enlarged perspective view of the appliance of FIG. 1 illustrating the handle in the extended upright position.

FIGS. 6 and 7 illustrate operation of handle retainers 32. FIG. 6 illustrates appliance 20 and handle 30 in the collapsed or folded state (also shown in FIG. 2). As shown by FIG. 6, portion 60 of bracket 50 is welded to a portion of frame 42 of appliance 20. In other embodiments, bracket 50 may be welded to other portions of appliance 20 or may be fastened or secured to appliance 20 in other fashions.

As further shown in FIG. 6, handle 30 includes an outwardly projecting shaft, projection, axle or pin 90 extending from handle 30 into apertures 64. Pin 90 is rotatable within apertures 64 to facilitate pivoting of handle 30 about axis 92. Pin 90 and apertures 66 are sufficiently spaced from portion 60 and portion 62 and are sufficiently close to an end of handle 30 such that an end of handle 30 may pivot or rotate within and between tabs 56 by about 90 degrees about axis 92. In other embodiments, handle 30 may include a bolt about which handle 30 pivots. In the example illustrated, in the folded or collapsed a shown in FIG. 6, handle 30 extends along an axis substantially perpendicular to portion 62. In other embodiments, handle 30 may pivot to different maximum angular extents.

As noted above, retainer 32 includes a pair of resiliently biased buttons, pins or projections 53. In the example illustrated, projections 53 are resiliently biased by a leaf spring 96 carried within handle 30. In other embodiments, projections 53 may be resiliently biased in an outward direction by a compression spring or other bias mechanisms. In some embodiments, projections 53 may alternatively comprise projections which are resiliently flexible, wherein the projections resiliently flex as they are snapped into at least apertures 86.

FIG. 7 illustrates handle 30 after it has been pivoted in the direction indicated by arrow 97 from the folded position shown in FIG. 6 to the extended position (also shown in FIG. 1). During such pivoting of handle 30, fingers 72 and tabs 58 both resiliently flex outward, allowing handle 30 to snap through constricted opening 80. During such insertion of handle 30 into mouth 76, buttons 94 engage or contact insert 72 and are compressed inwardly towards one another against bias 96. Once fully received within mouth 76, handle 30 is retained by three retention arrangements. Fingers 72 grip and frictionally contact opposite side of handle 32. Fingers 72 further wrap about greater than half of handle 30 with projections 82 inhibiting accidental dislodgment handle 30. Finally, buttons 94 project into at least apertures 86 and nominally apertures 86 and apertures 66. Thus, handle retainer 32 comprises a single mechanism offering three means for retaining handle 30 in the extended position.

To return handle 30 once again to the collapsed or folded state shown in FIG. 6, a person may manually push buttons 94 inwardly and then pivot handle 30. During such pivoting, fingers 72 and tabs 58 once again flex outwardly. In some embodiments, appliance 20 may initially include mechanisms for retaining handle 30 in the folded state. As noted above, in some embodiments, buttons 94 may be omitted or fasteners, such as a bolt and nut, may be used in place of buttons 94. In such embodiments, to move handle 32 the folded state, the bolt would be withdrawn from handle 30 and from apertures 86, 66 prior to pivoting of handle 30.

FIGS. 8-11 illustrate appliance 120, another embodiment of appliance 20. Appliance 120 is similar to appliance 20 except that appliance 20 includes handle retainer 132 in place of retainer 32. Those remaining elements of appliance 120 which correspond to elements of appliance 20 and which are shown in FIGS. 8-11 are numbered similarly. Handle retainer 132 is similar to handle retainer 32 in all respects except that handle 132 includes bracket 150 and projection 153 in place of bracket 50 and projection 53, respectively.

Bracket 150 is similar to bracket 50 in substantially all respects except that bracket 150 additionally includes detent 186. Detent 186 comprises a notch extending into one of tabs 58. As will be described hereafter, detent 186 forms part of a lock or latching mechanism for additionally retaining handle 30 in an extended position. In the example illustrated, handle 30 is pivotally coupled to tabs 56 of bracket 150 by fasteners 190 comprising a bolt 191, washers 192 and a nut 193 (shown in FIGS. 10 and 11) which are mounted to tabs 56 and wherein the bolt extends through handle 30. In other embodiments, handle 30 may be pivotably mounted to tabs 56 in other fashions.

Figure 8:
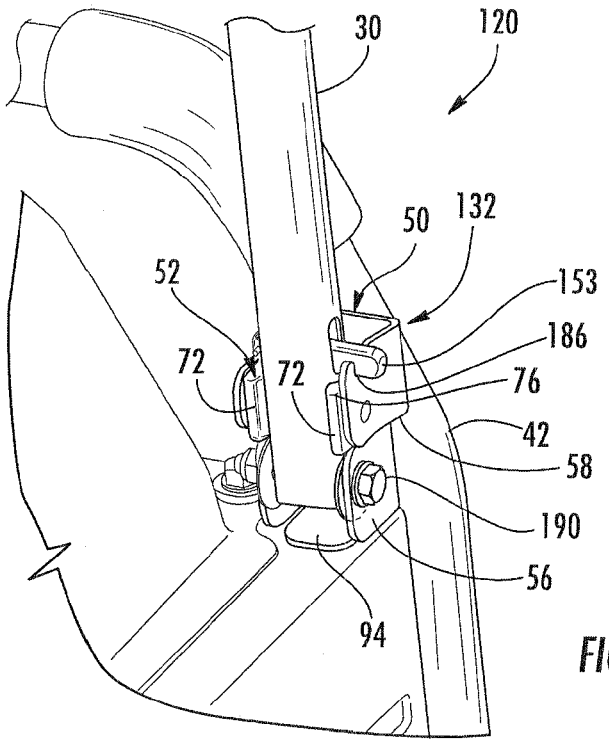
FIG. 8 is a fragmentary enlarged perspective view of the appliance of FIG. 1 including another embodiment of the handle retainer of FIG. 1 retaining the handle in the extended upright position.
Figure 11:
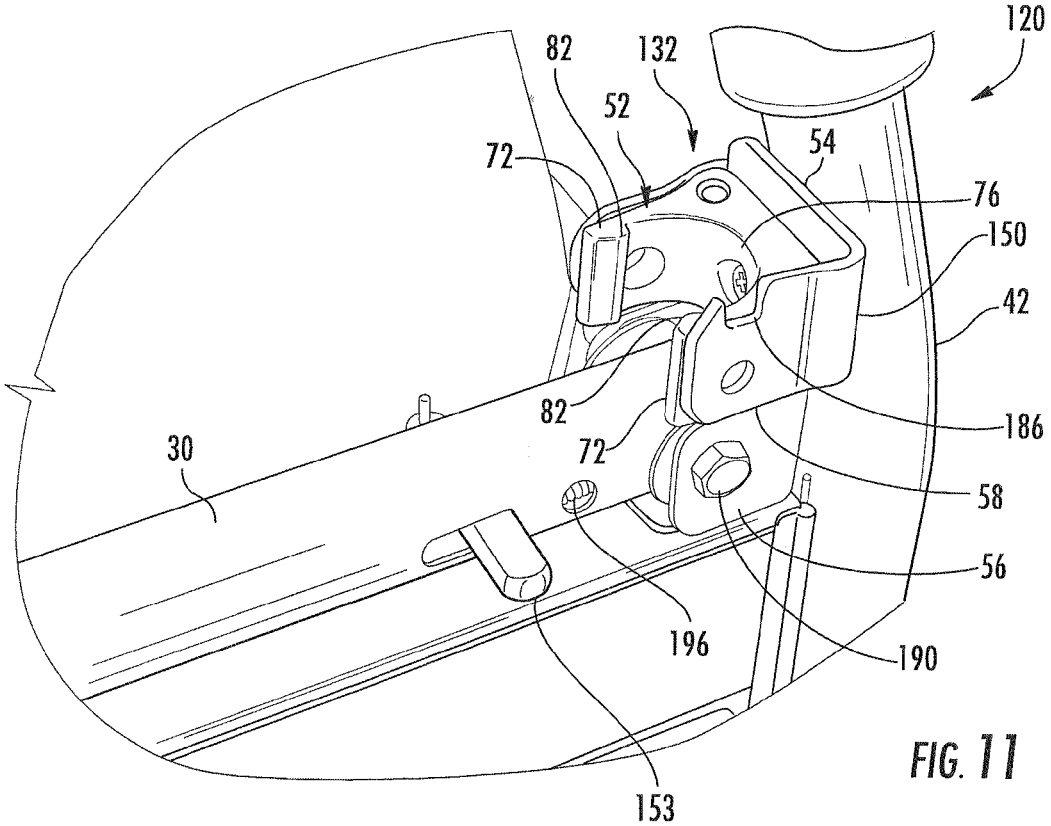
FIG. 11 is a fragmentary sectional view of the appliance of FIG. 10.
Figure 9:
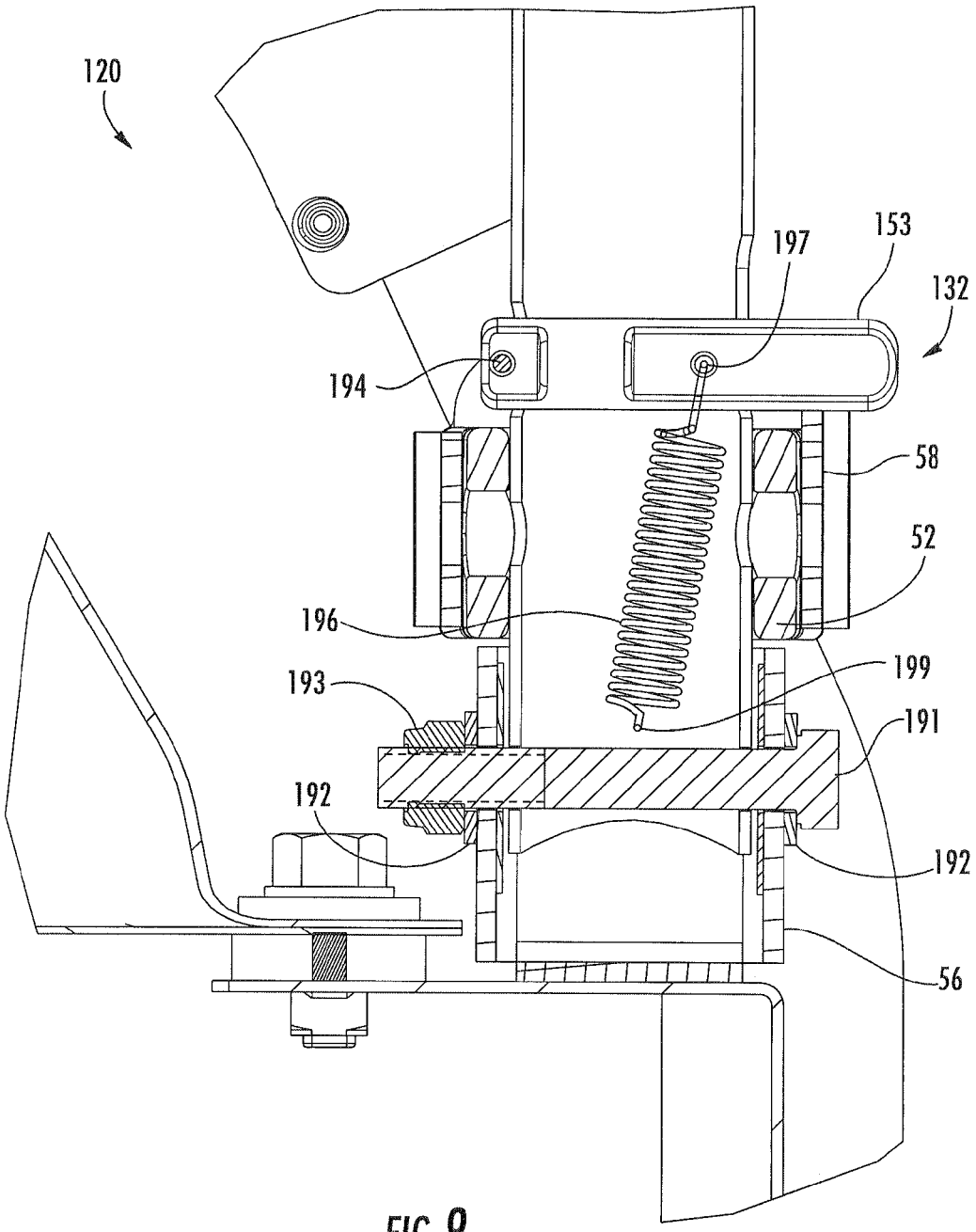
FIG. 9 is a fragmentary sectional view of the appliance of FIG. 8.
Figure 10:
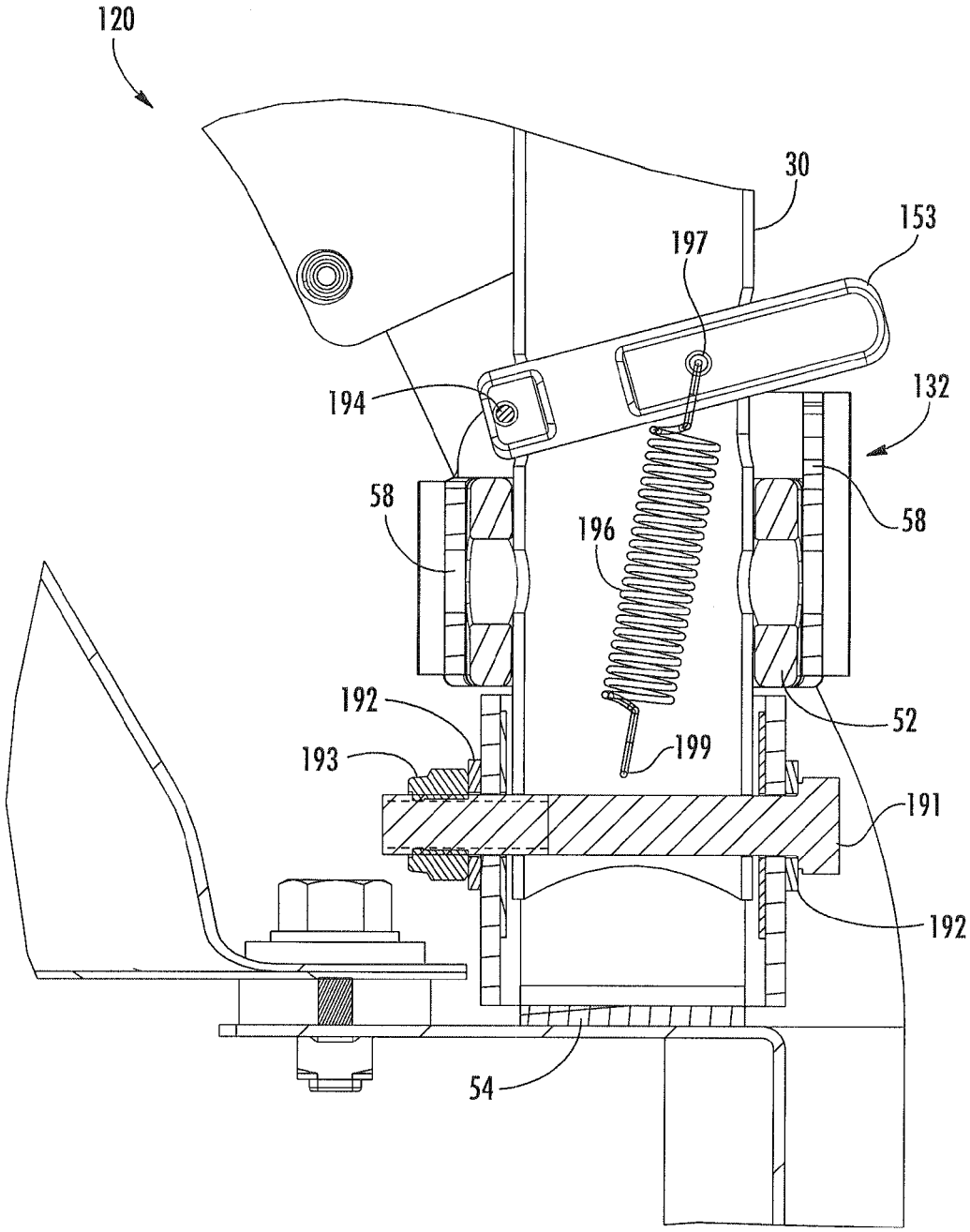
FIG. 10 is a fragmentary enlarged perspective view of the appliance of FIG. 1 illustrating the handle in a folded or collapsed position.

Projection 153 comprises a bar, shaft, projection or extension carried by and extending from handle 30. As shown by FIGS. 8 and 9, projection 153 is configured to be received within detent 186 when handle 30 is in the upright and extended position, assisting in retaining handle 30 in the upright extended position. As shown by FIGS. 10 and 11, projection 153 is also configured to be withdrawn or removed from detent 186, allowing handle 30 to be withdrawn from mouth 76 and to be pivoted to the collapsed or folded position.

In the example illustrated in FIGS. 9 and 10, projection 153 is pivotally coupled to handle 30 about a pivot pin 194 and is resiliently biased by a bias or spring 196. Spring 196 has a first end 197 connected to projection 153 and a second end 199 connected to handle 30. In the example illustrated, spring 196 is contained within an interior of handle 30. Spring 196 resiliently retains projection 153 in detent 186 when handle 30 is in the upright position. In particular, as handle 30 is being pivoted into mouth 76, spring 196 (a torsion spring) is stretched, allowing projection 153 to ride over a top of tabs 58. Once received within mouth 76 and when projection 153 is over detent 186, spring 196 automatically urges projection 153 into detent 186. This may be done without any manual manipulation of projection 153 during movement of handle 32 the upright position. To fold or collapse handle 30, projection 153 is manually lifted against the bias of spring 196 out of detent 186, allowing handle 30 to be pivoted out of mouth 76. In other embodiments, spring 196 may be omitted, wherein gravity retains projection 153 in detent 186. In other embodiments, projection 153 and spring 196 may be omitted.

Figure 12:
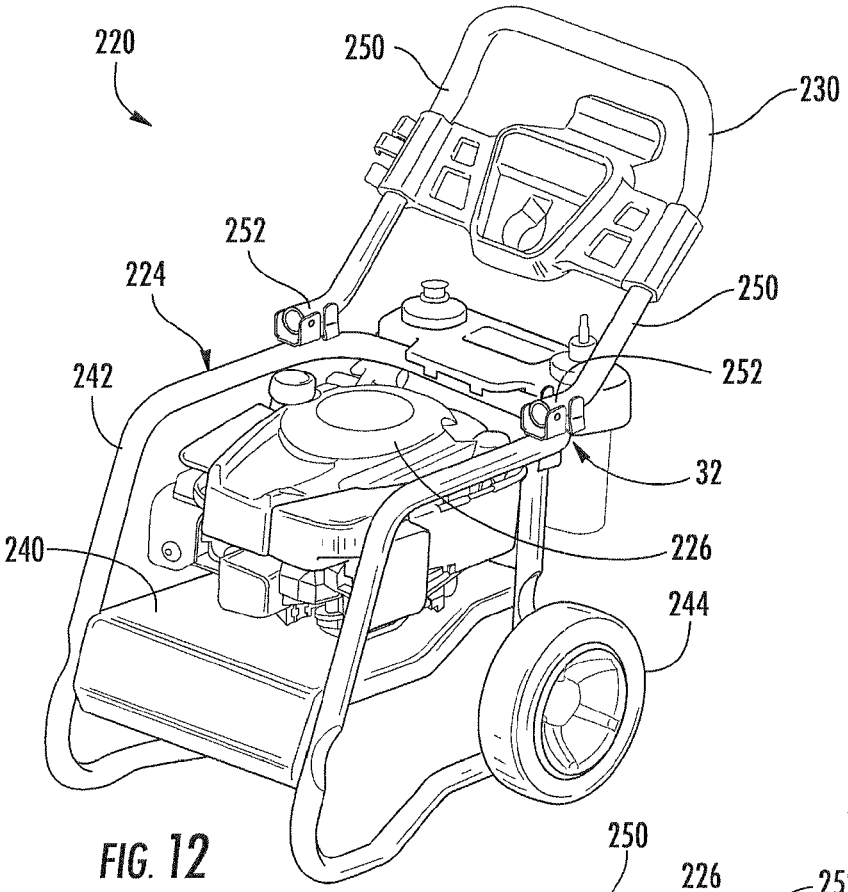
FIG. 12 is a top perspective view of another embodiment of the appliance of FIG. 1 with a handle retainer retaining a handle in an extended upright position.
Figure 13:
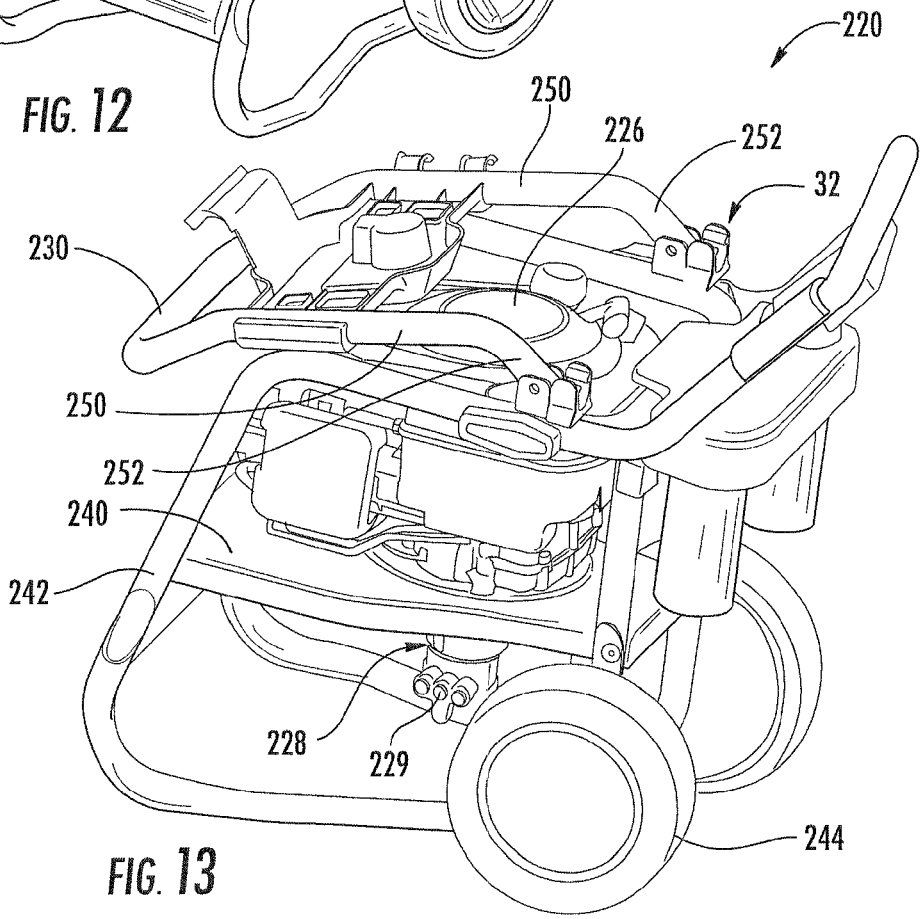
FIG. 13 is a rear perspective view of the appliance of FIG. 12 illustrating the handle in a collapsed or folded position.

FIGS. 12 and 13 illustrate foldable appliance 220, another embodiment of appliance 20. In the example illustrated, appliance 220 comprises a fluid sprayer and includes support 224, drive unit 226, working unit 228, handle 230 and handle retainer 232. Support 224 comprises one or more structures configured to serve as a foundation for supporting the remaining components of the foldable appliance. In the example illustrated, support 224 includes platform 240, frame 242 and wheels 244. Platform 240 comprises a base supporting drive unit 226 and working unit 228. In other embodiments, platform 240 may comprise a bracket, a frame or other structures.

Frame 242 comprises a series of beams, brackets or other structures extending between platform 240, wheels 244 and handle 230. Although illustrated as being formed from a shaped tubular member, frame 42 may have other configurations.

Wheels 244 are rotationally coupled to frame 242 and assist in elevating portions of frame 242 and platform 240 above a supporting surface or ground. In the example illustrated, wheels 244 freely rotate or idle. In other embodiments, wheels 244 may be powered or driven by an engine or motor. Although foldable appliance 220 is illustrated as including a pair of wheels 244 (one of which is shown), wherein a front end of frame 242 rests upon the ground or underlying surface, in other embodiments, appliance 220 may include three, four or additional wheels. In yet another embodiment, wheels 244 may be omitted or replaced with other ground motive mechanisms such as tracks, skis or the like. Although wheels 244 are illustrated as being rotationally coupled to frame 242, in other embodiments, wheels 244 may alternatively be operably coupled to platform 420 or to portions of drive unit 226 or working unit 228.

Drive unit 226 comprises a unit or mechanism configured to provide or supply torque or other motive force to working unit 228. In the example illustrated, drive unit 226 comprises an internal combustion engine operably coupled to working unit 228 and supported by support 224. In other embodiments, drive unit 226 may alternatively comprise electrically powered motor. In the yet other embodiments, drive unit 226 may be omitted, such as where working unit 228 is manually powered.

Working unit 228 comprises one or more mechanisms configured to utilize the received torque or force to transform or work upon the surrounding environment or a medium. In the example illustrated, working unit 228 comprises fluid pump 229 connectable to a hose and spray gun (not shown). Fluid pump 229 is suspended below platform 240 and is configured to pressurize fluid, such as water. According to one embodiment, the pump serving as working unit 250 comprises a pump at least similar to the pump shown and described in U.S. Pat. No. 6,092,998 to Dexter et al. which issued on Jul. 25, 2000, the full disclosure of which is hereby incorporated by reference. Appliance 220 allows a person to selectively control and direct the emission of pressurized fluid.

In other embodiments, working unit 228 may comprise mechanisms configured to perform other functions. For example, in other embodiments, working unit 228 may comprise transmission and cutting blades of a lawnmower, trimmer or other cutting mechanism, the transmission and auger of a snow thrower or snow blower, the transmission and tines or blades of a tiller, the electrical power generating components of an electrical generator or other working mechanisms.

Handle 230 extends from support 224 and is configured to be manually grasped by a person using appliance 220, allowing the person to reposition and move appliance 220. Handle 230 includes central portions 250 and angularly bent end portions 252. End portions 252 extend from central portions 250 at an angle such that when end portions 252 extend substantially horizontally, central portions 252 extends substantially vertical, between about 90 degrees and 30 degrees with respect to horizontal. FIG. 13 illustrates portion 250 extending rearwardly approximately 45 degrees with respect to horizontal. In the example illustrated, handle 230 comprise tubular members. In other embodiments, handle 230 may alternatively have other cross-sectional shapes.

Handle retainer 232 is identical to handle retainer 32 except that handle retainer 232 is mounted to frame 242 in a different orientation. In particular, portion 62 of base 54 (shown in FIG. 3) is coupled to and against frame 242 with mouth 76 of insert 72 facing in an upward direction rather than a forward direction. As a result, when mouth 76 receives handle 230, portion 252 of handle 230 is horizontal while portion 250 is upright, allowing a person to use handle 230. As with retainer 32, retainer 232 provides a single mechanism or arrangement for: (1) pivotably supporting handle 230 and a (2) securely retaining handle 230 in an upright position during use.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a frame;

a foldable handle pivotably connected to the frame;

resiliently movable fingers configured to receive a portion of the foldable handle therebetween to retain the handle against folding relative to the frame;

a detent in one of the portion of the handle and the fingers; and a projection projecting from the other of the portion of the handle and the fingers, wherein one of the projection and the detent is resiliently biased into locking engagement with the other of the projection and the detent.

2. The apparatus of claim 1, wherein the detent extends into one of the fingers.

3. The apparatus of claim 2 further comprising:

a second detent in the fingers opposite the detent; and a second projection carried by the handle and resiliently biased into the detent when the handles received between the fingers.

4. The apparatus of claim 3, wherein the detent and the second detent comprise a first finger opening and a second finger opening, respectively.

5. The apparatus of claim 4 further comprising a bracket receiving and supporting the fingers, the bracket including a first bracket opening and a second bracket opening aligned with the first finger opening and the second finger opening, respectively.

6. The apparatus of claim 5, wherein the bracket pivotably mounts the handle to the frame.

7. The apparatus of claim 5, where the bracket comprises:

a base;

first and second opposing tabs extending from the base and spaced apart by a first distance, the first and second opposing tabs pivotably supporting the handle; and third and fourth opposing tabs extending from the base and spaced apart by a second distance greater than the first distance, the third and fourth opposing tabs supporting the resiliently movable fingers.

8. The apparatus of claim 1, wherein the fingers form a C-shaped channel.

9. The apparatus of claim 1, wherein the resiliently movable fingers form a channel within a channel opening facing in a first direction and wherein the projection extends in a second direction perpendicular to the first direction.

10. An apparatus comprising:

a frame;

a foldable handle pivotably connected to the frame;

resiliently movable fingers configured to receive a portion of the foldable handle therebetween to retain the handle against folding relative to the frame;

a bracket supporting the fingers;

a detent in one of the portion of the handle and the bracket; and a projection projecting from the other of the portion of the handle and the bracket, wherein one of the projection and the detent is resiliently biased into locking engagement with the other of the projection and the detent.

11. The apparatus of claim 10, wherein the resiliently movable fingers form a channel within a channel opening facing in a first direction and wherein the projection extends in a second direction perpendicular to the first direction.

12. The apparatus of claim 10, wherein the bracket receives the fingers.

13. The apparatus of claim 10, wherein the detent extends into one of the fingers and wherein the apparatus further comprises:

a second detent in the fingers opposite the detent; and a second projection carried by the handle and resiliently biased into the detent when the handles received between the fingers, wherein the detent and the second detent comprise a first finger opening and a second finger opening, respectively, and wherein the bracket receives the fingers and is configured to pivotably mount the handle to the frame, the bracket further comprising:

a first bracket opening; and a second bracket opening aligned with the first finger opening and the second finger opening, respectively.

14. An apparatus comprising:

a foldable handle retainer comprising:

a bracket for being coupled to a frame, the bracket comprising:

a base;

first and second opposing tabs extending from the base and spaced apart by a first distance, the first and second opposing tabs adapted to pivotably support a handle; and third and fourth opposing tabs extending from the base and spaced apart by a second distance greater than the first distance; and an insert between the third and fourth tabs, the insert including a first resiliently movable finger and a second resiliently movable finger opposing the first resiliently movable finger, the first finger and the second finger configured to receive a portion of the handle therebetween to retain the handle against pivoting relative to the retainer.

15. The apparatus of claim 14 further comprising:

first and second opposing detents in the first and second fingers adapted to receive resiliently biased projections extending from the handle.

16. The apparatus of claim 15, wherein the first and second opposing detents comprise a first finger opening extending completely through the first finger and a second finger opening extending completely through the second finger.

17. The apparatus of claim 16, wherein the bracket includes a first bracket opening and a second bracket opening aligned with the first finger opening and the second finger opening, respectively.

18. The apparatus of claim 14, wherein the first and second fingers, together, form a C-shaped channel.

19. The apparatus of claim 14 further comprising a notch in one of the third and fourth opposing tabs, the notch being configured to receive a projection extending from the handle.

20. The apparatus of claim 14, wherein the third and fourth tabs are resiliently flexible away from one another independent of the first and second tabs.

* * * * *